US007409928B2

(12) United States Patent
Rizoulis et al.

(10) Patent No.: US 7,409,928 B2
(45) Date of Patent: Aug. 12, 2008

(54) METHOD FOR DESIGNING AN ENGINE COMPONENT TEMPERATURE ESTIMATOR

(75) Inventors: Dimitrios Rizoulis, Ann Arbor, MI (US); Gary D. Mandrusiak, Utica, MI (US); Chandran B. Santanam, Rochester HIlls, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 58 days.

(21) Appl. No.: 11/341,196

(22) Filed: Jan. 27, 2006

(65) Prior Publication Data

US 2007/0175415 A1 Aug. 2, 2007

(51) Int. Cl.
*F01P 9/00* (2006.01)

(52) U.S. Cl. ..... 123/41.01; 701/101

(58) Field of Classification Search ..... 123/41.01, 123/701; 60/39.83; 165/41; 180/68.4; 237/70
See application file for complete search history.

(56) References Cited

U.S. PATENT DOCUMENTS

| | | | | |
|---|---|---|---|---|
| 4,437,445 | A * | 3/1984 | Takahashi et al. | 123/491 |
| 6,367,970 | B1 * | 4/2002 | Danielson | 374/43 |
| 6,415,276 | B1 * | 7/2002 | Heger et al. | 706/52 |
| 6,477,219 | B2 * | 11/2002 | Hirukawa et al. | 376/255 |
| 6,484,490 | B1 * | 11/2002 | Olsen et al. | 60/39.281 |
| 7,128,026 | B2 * | 10/2006 | Braun et al. | 123/41.01 |
| 2002/0070195 | A1 * | 6/2002 | Wado et al. | 216/2 |
| 2002/0111734 | A1 * | 8/2002 | Wakahara et al. | 701/114 |
| 2006/0213461 | A1 * | 9/2006 | Hayami | 123/41.15 |
| 2006/0293146 | A1 * | 12/2006 | Nakayashiki et al. | 477/76 |

OTHER PUBLICATIONS

Wagner, J.R., Srinivasan, V., Dawson, D.M., and Marotta, E.E., "Smart Thermostat and Coolant Pump Control for Engine Thermal Management Systems", Society of Automotive Engineers, Paper No. 2003-01-0272, 2003.

Wagner, J.R., Ghone, M.C., Dawson, D.W., and Marotta, E.E., "Coolant Flow Control Strategies for Automotive Thermal Management Systems", Society of Automotive Engineers, Paper No. 2002-01-0713, 2002.

Lehner, C., Parker, G., Arici, O., and Johnson, J., "Design and Development of a Model Based Feedback Controlled Cooling System for Heavy Duty Diesel Truck Applications Using a Vehicle Engine Cooling System Simulation", Society of Automotive Engineers, Paper No. 2001-01-0336, 2001.

Yoo, I.K., Simpson, K., Bell, M., and Majkowski, S., "An Engine Coolant Temperature Model and Application for Cooling System Diagnosis", Society of Automotive Engineers, Paper No. 2000-01-0939, 2000.

Tomlinson, S.P., and Burrows, C.R., "Design of a Feedback Controlled Thermostat for a Vehicle Cooling System", Society of Automotive Engineers, Paper No. 961823, 1996.

(Continued)

*Primary Examiner*—Noah Kamen

(57) ABSTRACT

A method of estimating temperature in an engine including estimating metal temperatures at each of a plurality of nodes and estimating a coolant temperature. The method further includes detecting a measured coolant temperature and determining a gain based on a difference between the estimated coolant temperature and the measured coolant temperature. The method adjusts the metal temperatures at each of the plurality of nodes based on the gain. The method estimates the metal temperatures of engine components without temperature sensors.

20 Claims, 4 Drawing Sheets

OTHER PUBLICATIONS

Krause, W. and Spies, K.H., "Dynamic Control of the Coolant Temperature for a Reduction of Fuel Consumption and Hydrocarbon Emission", Society of Automotive Engineers, Paper No. 960271, 1996.

Yang, J., "Coolant Pump Throttling—A Simple Method to Improve the Control Over SI Engine Cooling System", Society of Automotive Engineers, Paper 961813, 1996.

Couetouse, H., and Gentile, D., "Cooling System Control in Automotive Engines", Society of Automotive Engineers, Paper No. 920788, 1992.

McBride, J.W., and Reed, M.J., "An Electrically Driven Automotive Coolant Pump", IMechE Paper No. C391/054, 1989.

Einaudi, G., and Mortar, W., "Engine Cooling Electronic Control System", Society of Automotive Engineers, Paper No. 885085, 1988.

* cited by examiner

METHOD FOR DESIGNING AN ENGINE COMPONENT TEMPERATURE ESTIMATOR

FIELD

The present invention relates to engine control, and more particularly to an engine temperature estimator.

BACKGROUND

Internal combustion engines create heat through combustion, friction and various component inefficiencies. A cooling system regulates the temperature of the engine to protect the engine from excessive heat and to promote efficient combustion. A cold engine may be less efficient and may produce increased emissions. An overly hot engine increases stress on engine components and may cause mechanical failures.

The internal combustion engine typically operates more efficiently when regions within the engine are maintained at different temperatures. For example, the engine may benefit from a lower temperature in the bottom of the engine relative to the top of the engine. To maintain different temperatures in the regions of the engine, traditional cooling systems typically employ multiple sensors that measure and track metal temperatures in the engine. It can be appreciated that measuring metal temperatures in a mass production engine can be complex and costly. For example, any additional sensors increase production costs, add to engine complexity and increase vehicle warranty costs.

SUMMARY

A method of estimating temperature in an engine including estimating metal temperatures at each of a plurality of nodes and estimating a coolant temperature. The method further includes detecting a measured coolant temperature and determining a gain based on a difference between the estimated coolant temperature and the measured coolant temperature. The method adjusts the metal temperatures at each of the plurality of nodes based on the gain. The method estimates the current metal temperatures without temperature sensors.

In one feature, the method distributes an amount of engine coolant to a plurality of engine locations based on said temperatures.

Further areas of applicability of the present invention will become apparent from the detailed description provided hereinafter. It should be understood that the detailed description and specific examples, while indicating the various embodiments of the invention, are intended for purposes of illustration only and are not intended to limit the scope of the invention.

BRIEF DESCRIPTION OF THE DRAWINGS

The present invention will become more fully understood from the detailed description, the appended claims and the accompanying drawings, wherein:

DETAILED DESCRIPTION

The following description of the various embodiments is merely exemplary in nature and is in no way intended to limit the invention, its application or uses. As used herein, the term module refers to an application specific integrated circuit (ASIC), an electronic circuit, a processor (shared, dedicated, or group) and memory that executes one or more software or firmware programs, a combinational logic circuit, or other suitable components that provide the described functionality. Moreover, vehicle controllers may communicate with various vehicle systems using digital or analog inputs and outputs and/or an automotive communications network including, but not limited to, the following commonly used vehicle communications network standards: CAN, SAE J1850, and GMLAN.

Figure 1:
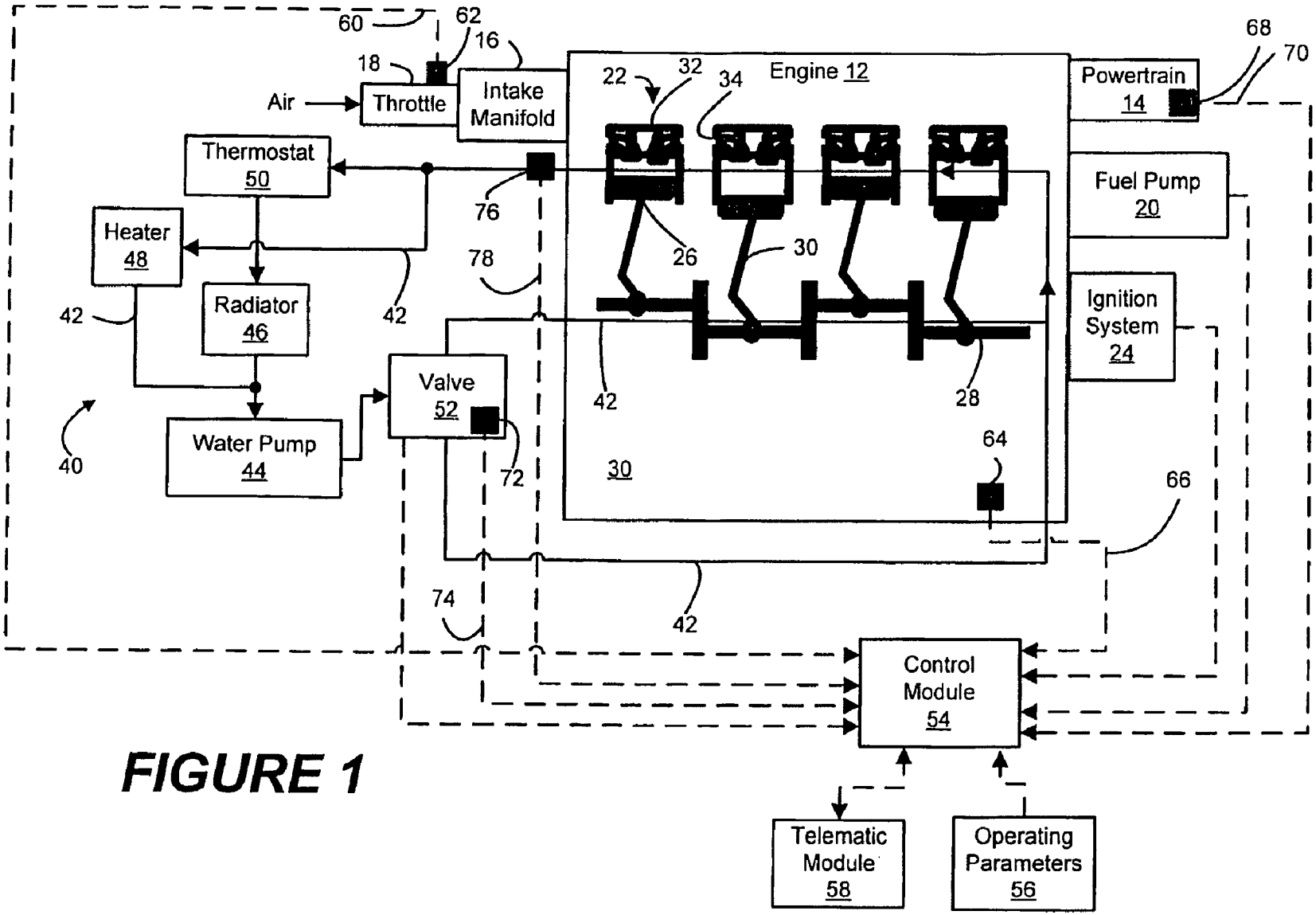
FIG. 1 is a schematic diagram illustrating a vehicle including a control module constructed in accordance with the teachings of the present invention.

Referring now to FIG. 1, a portion of a vehicle 10 includes an engine 12 that produces a torque output to drive the vehicle 10 through a powertrain 14 in a manner known in the art. The engine 12 can be an internal combustion engine. It can be appreciated that the engine 12 could also be configured with a variety of powerplant configurations, such as, but not limited to, fuel cell and/or battery powered electric machines, internal combustion engines such as diesel, biomass, gasoline, and natural gas consuming engines, and hybrid combinations thereof.

The engine 12 includes an intake manifold 16 and a throttle 18. Airflow into the intake manifold 16 is regulated by the throttle 18. The airflow from the intake manifold 16 and fuel from a fuel pump 20 is ignited in a plurality of cylinders 22 by an ignition system 24, in a manner known in the art. Combustion in each of the cylinders 22 pushes a piston 26 toward a crankshaft 28, to which the piston 26 is attached by a connecting rod 30. An up and down motion of the piston 26 is transmitted to the crankshaft 28 resulting in rotational power being delivered to the powertrain 14. It is appreciated that while the illustrated engine utilizes a spark ignition, the present invention applies to diesel and other sparkless compression ignition engines.

Each of the cylinders 22 includes a cylinder head 32, a valve bridge 34 and a cylinder liner 36. The cylinders 22 are located in an engine block 38. It is appreciated that the components of the engine 12 can produce, and retain heat. Moreover, the components of the engine 12 can transfer heat between and amongst the components through conduction, convection, radiation and/or advection. As such, a cooling system 40, which is connected to the engine 12, provides cooling to the components and regions of the engine 12.

The cooling system 40 directs coolant through a plurality of cooling channels 42 to cool the various components and regions of the engine 12. The cooling system 40 includes a water pump 44, which propels coolant throughout the plurality of cooling channels 42. The water pump 44 can be an electric water pump with a variable flow rate. It can be appreciated that a mechanical water pump can also be used that is otherwise mechanically driven off the engine 12. The cooling system 40 also includes a radiator 46 and a heater 48. The radiator 46 reduces the temperature of the coolant by transferring heat from the coolant to the outside of the vehicle 10. The heater 48 can also reduce the temperature of the coolant by transferring heat from the coolant to the inside of the vehicle 10. A thermostat 50 can prevent delivery of coolant to the radiator 46 during engine warm-up in a manner known in the art.

The cooling system 40 includes the water pump 44 and a valve 52, both of which can communicate with a control module 54. The control module 54 can control a variable flow rate of the water pump 44. The control module 54 can communicate with the valve 52 to distribute coolant between various components and regions of the engine 12. More specifically, the cylinder head 32 and the engine block 38, which can be referred to as a top of the engine and a bottom of the engine, respectively, can operate more efficiently at different respective temperatures. Moreover, the cooling system 40 can more efficiently cool the engine 12 by controlling distribution of coolant. As such, the water pump 44 and the valve 52 can be controlled by the control module 54 to direct varying coolant volumes to the top of the engine and the bottom of the engine to maintain optimum temperatures in the various regions of the engine.

The control module 54 can also control operations of the vehicle 10 based on vehicle operating parameters 56 that can include environmental indicators such as humidity, temperature or air pressure. The vehicle operating parameters 56 can also include a powerplant profile and a powerplant status that indicates, for example, a cold engine signal or engine controller faults. It is appreciated that a cold engine refers to the temperatures of the respective components of the engine 12 being approximately equal to the ambient temperature conditions. As such, the cold engine temperature can refer to an engine temperature in the range of about 0° C. (32° F.) to about 32° C. (90° F.). The powerplant profile can include lookup data that indicates, for example, a torque output based on spark retardation, torque output based on engine speed and effects of the environmental indicators on engine power. A telematic module 58, such as OnStar® can also provide input to and receive output from the control module 54.

The control module 54 can generate a throttle control signal 60 that is sent to a throttle actuator 62 that regulates the throttle 18. An engine speed sensor 64 generates an engine speed signal 66 for engine 12, which is also communicated to the control module 54. A powertrain speed sensor 68 generates a power train speed signal 70, which is also communicated to the control module 54. An entrance coolant temperature sensor 72 transmits an entrance coolant temperature signal 74 to the control module 54. Similarly, an exit coolant temperature sensor 76 transmits an entrance coolant temperature signal 78 to the control module 54. It is appreciated that while a single entrance coolant temperature sensor 72 is illustrated adjacent to the valve 52, two entrance coolant temperature sensors can be used and located at the locations of the engine 12 that correspond to the top and bottom of the engine respectively.

Figure 2:
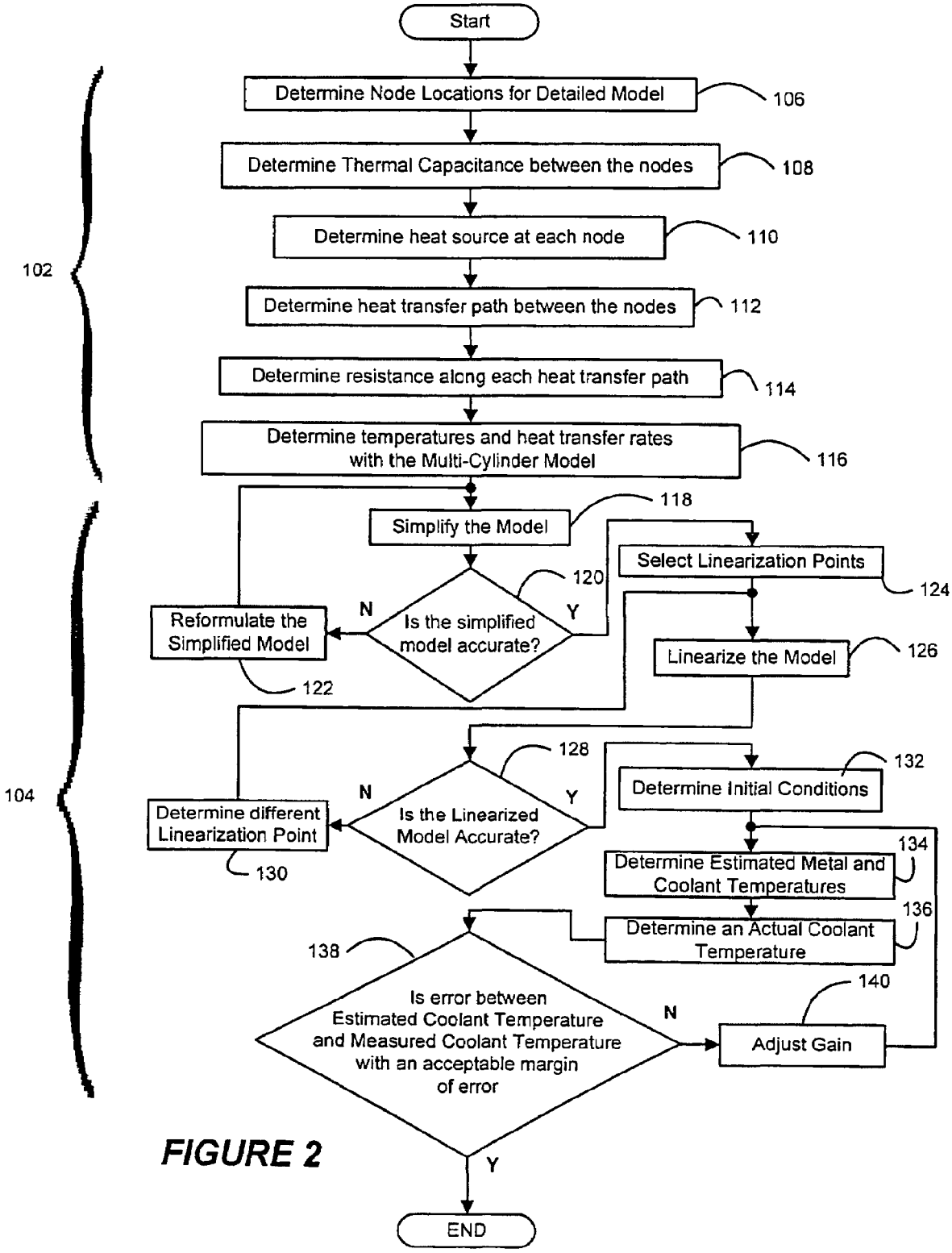
FIG. 2 is a flow chart illustrating a methodology for designing an engine component temperature estimator in accordance with the teachings of the present invention.

With reference to FIG. 2, a methodology is shown that develops an engine temperature estimator model from which an engine temperature estimator control system can be derived and implemented in a vehicle. To develop the engine temperature estimator model, the methodology can include, for example, a first portion 102 and a second portion 104, as shown in FIG. 2. In the first portion 102, a detailed multi-cylinder engine temperature model is created that models heat transfer and heat generation throughout an engine. In the second portion 104, the detailed multi-cylinder engine temperature model is simplified and linearized to develop an exemplary engine temperature estimator control system.

In step 106, a plurality of node locations are determined for the detailed multi-cylinder engine temperature model. For example, the detailed model locates five nodes per each cylinder in the engine block, the cylinder head, the valvebridge, the cylinder liner and the engine coolant. It is appreciated that the nodes can be located in various other locations in the engine such as, but not limited to, the piston, an oil reservoir, a camshaft or a piston ring. Moreover, the methodology can be applied to engines with various configurations having, for example, a varying numbers of cylinders. The nodes, for example, can represent physical location that corresponds to a position on the engine component. By way of example, the node can represent a portion of cylinder liner in one cylinder.

In step 108, a thermal capacitance is determined at each of the nodes. The thermal capacitance is based on, for example, the geometry, material properties and temperature of the engine components or portion thereof that each node represents. In step 110, a heat source is determined at each of the nodes to account for heat generation from the engine component in which the node is located. The heat generation or heat loss can be produced by friction, combustion or other losses within the engine. As such, values are computed for these heat sources using, for example, vehicle operating parameters including, but not limited to, engine speed, engine load, manifold pressure and fuel flow rate.

In step 112, heat transfer paths are determined between each of the nodes. It can be appreciated that in the internal combustion engine all of the nodes can exchange heat. In other examples, the nodes may be located such that no heat transfer occurs between two or more of the nodes because one node may be thermally insulated from another node. It is appreciated that one or more of the appropriate equations for heat transfer (i.e. conduction, convection, radiation and/or advection) are used to determine the heat transfer paths. In step 114, resistances are determined along each of the heat transfer paths. The resistances are based on, for example, geometry of the engine component, flow rate to and from the engine component and material properties of the engine components or portions thereof.

In step 116, engine temperatures and heat transfer rates are determined using the detailed multi-cylinder engine temperature model as constructed in the first portion 102 of the methodology. To determine the temperatures and heat transfer rates, the engine is operated through a plurality of engine operating points selected from a standardized engine test. The test includes, for example, a plurality of test points that can correspond to a certain load on the engine at a certain engine speed for predetermined time periods. The detailed multi-cylinder model, which is a detailed heat transfer model of the engine, determines the engine temperatures and heat transfer rates based on how heat is created and transferred around the engine during the test over a plurality of engine operating points. It can be appreciated that the detailed model can be adjusted to better predict engine temperatures and heat transfer paths by confirming estimated temperatures with measured temperatures and iterating the design of the detailed model as produced in the first portion 102 of the methodology.

It can also be appreciated that the detailed model can accurately estimate metal temperatures of various engine components and portions thereof relative to physically installed temperature sensors. The detailed model can provide accurate estimated engine temperatures and heat transfer rates, but the detailed model can be complex and costly to implement into an engine control system because of, for example, modifications and additional computational power required. The detailed model, however, can be simplified and still provide accurate control. In step 118, the detailed model created in the first portion 102 of the methodology is simplified. The simplified model retains all of the parameters needed to predict engine temperatures such as, for example, coolant flow rate, engine speed and fuel flow rate, but is less complex and therefore easier to implement on the vehicle. In simplifying the detailed model, different configurations and resolutions can be used so that temperatures estimated by the simplified model match those obtained with the detailed model over a sufficient range of engine operating scenarios.

The simplified model includes a system of first-order differential equations generated for a plurality of engine nodal lumps. It is appreciated that the number of engine nodal lumps can vary based on the specific engine, nevertheless five engine nodal lumps were determined to provide the best balance between accuracy and complexity. The engine nodal lumps, while having no actual physical locations, are ideal conglomerations of each of the respective nodes located, for example, at the engine block, the cylinder head, the valvebridge, the cylinder liner and the engine coolant. More specifically, the nodes at the valvebridge for each cylinder are combined into one valvebridge nodal lump and the temperature of that nodal lump is the combined metal temperature estimates of the respective nodes tracked over time. Thermal capacitances and heat sources of each of the nodal lumps can include the sums of the corresponding values from each of the nodes in the detailed multi-cylinder model. The resistance of the heat transfer paths in the nodal lumps can be the sums of the resistance from the nodes, which can be adjusted to ensure that the different engine components exchange thermal energy in the simplified model at similar rates as they did in the detailed model.

The simplified model, therefore, includes an exemplary system of first-order differential equations for the nodal lumps that define the simplified model. It is appreciated that the system of first order different equations may not be linear but adequately track the values produced by the detailed multi-cylinder model. Each of the equations tracks temperature over time for the respective nodal lumps.

The exemplary first-order equation for the cylinder head is provided as follows:

$$C_H \frac{dT_H}{dt} = Q_H(m_F, N_E) + G_{HC}(m_F, m_{CH})(T_C - T_H) + G_{VH}(m_F, m_{CH})(T_V - T_H)$$

The exemplary first-order equation for the valvebridge is provided as follows:

$$C_V \frac{dT_V}{dt} = Q_V(m_F, N_E) + G_{VH}(m_F, m_{CB})(T_H - T_V)$$

The exemplary first-order equation for the engine block is provided as follows:

$$C_B \frac{dT_B}{dt} = Q_B(m_F, N_E) + G_{BC}(m_F, m_{CB})(T_C - T_B) + G_{LB}(m_F)(T_L - T_B)$$

The exemplary first-order equation for the cylinder liner is provided as follows:

$$C_L \frac{dT_L}{dt} = Q_L(m_F, N_E) + G_{LC}(m_F, m_{CB})(T_C - T_L) + G_{LB}(m_F)(T_B - T_L)$$

The exemplary first-order equation for the coolant is provided as follows:

$$C_C \frac{dT_C}{dt} = G_{HC}(m_F, m_{CH})(T_H - T_C) + G_{BC}(m_F, m_{CB})(T_B - T_C) + G_{LC}(m_F)(T_L - T_C) + m_{CH}c_{PC}(T_{CIN} - T_C)$$

Values are generated for the coefficients in the above equations by running the detailed multi-cylinder model through a pre-determined routine such as the above-mentioned exemplary engine test. In the above equations, the coefficient $G_{XY}$ refers to heat transfer between arbitrary location X and arbitrary location Y. $G_{HC}$, for example, refers to heat transfer between the cylinder head and the engine coolant. $Q_X$ refers to heat generated at arbitrary location X. $Q_B$, for example, refers to heat generated in the engine block. By way of the above example, the detailed model is run in a steady-state mode for a plurality of points selected from a standardized engine test to generate the previously mentioned coefficients. Once the coefficients of the above equations are generated in the detailed model, the coefficients are adapted to the simplified model. It can appreciated that the simplification of the detailed multi-cylinder model is an iterative process in which results obtained from the simplified model can be compared with results from the detailed model and from actual measurement so that the simplified model can be made more accurate. While the simplification of the detailed model can produce non-linear equations, the equations are less complex and can be implemented in a vehicle control system.

In step 120, it is determined whether the simplified model generated in step 118 is accurate. Accuracy of the simplified model is based on results of the standardized engine test, which are used to produce the coefficients of the equations generated in step 118. The simplified model is considered accurate when the metal and coolant temperature estimates over a time period at the nodal lumps from the simplified model are within a pre-determined margin of error of the estimates from the detailed model. When the simplified model is inaccurate, the simplified model is reformulated in step 122. Reformulation of the simplified model can include, for example, adjusting the fit of the polynomials to produce non-linear first-order equations. When the simplified model is accurate, linearization points are selected in step 124.

In step 124, a plurality of operating or linearization points are selected from the standardized engine test and are points about which the above equations are linearized. The operating points or linearization points include known temperatures and coolant flow rates throughout the engine. The operating points also include various engine speeds, fuel flow rates and coolant temperatures of the engine. It is appreciated that the operating points can be selected from the same standardized engine test used to generate the coefficients for the above equations and iteratively improve the detailed multi-cylinder model.

In step 126, the simplified model, as shown in the above exemplary non-linear equations for the head, valvebridge, block, liner and coolant temperatures, is linearized around a selected operating point. Techniques used to linearize the above exemplary equations can include, for example, Taylor Series expansions. The exemplary linearized equation for the cylinder head is provided as follows:

$$C_H \frac{dT_H}{dt} = a_{HH}T_H + a_{HV}T_V + a_{HB}T_B + a_{HL}T_L + a_{HC}T_C + b_{H1}m_F + b_{H2}m_{CH} + b_{H3}m_{CB} + b_{H4}Q_H + b_{H5}Q_V + b_{H6}Q_B + b_{H7}Q_L + b_{H8}T_{CIN} + Cst_H$$

The exemplary linearized equation for the valvebridge is provided as follows:

$$C_V \frac{dT_V}{dt} = a_{VH}T_H + a_{VV}T_V + a_{VB}T_B + a_{VL}T_L + a_{VC}T_C + b_{V1}m_F + b_{V2}m_{CH} + b_{V3}m_{VB} + b_{V4}Q_H + b_{V5}Q_V + b_{V6}Q_B + b_{V7}Q_L + b_{V8}T_{CIN} + Cst_V$$

The exemplary linearized equation for the engine block is provided as follows:

$$C_B \frac{dT_B}{dt} = a_{BH}T_H + a_{BV}T_V + a_{BB}T_B + a_{BL}T_L + a_{BC}T_C + b_{B1}m_F + b_{B2}m_{CH} + b_{B3}m_{VB} + b_{B4}Q_H + b_{B5}Q_V + b_{B6}Q_B + b_{B7}Q_L + b_{B8}T_{CIN} + Cst_B$$

The exemplary linearized equation for the cylinder liner is provided as follows:

$$C_L \frac{dT_L}{dt} = a_{LH}T_H + a_{LV}T_V + a_{LB}T_B + a_{LL}T_L + a_{LC}T_C + b_{L1}m_F + b_{L2}m_{CH} + b_{L3}m_{VB} + b_{L4}Q_H + b_{L5}Q_V + b_{L6}Q_B + b_{L7}Q_L + b_{L8}T_{CIN} + Cst_L$$

The exemplary linearized equation for the coolant is provided as follows:

$$C_C \frac{dT_C}{dt} = a_{CH}T_H + a_{CV}T_V + a_{CB}T_B + a_{CL}T_L + a_{CC}T_C + b_{C1}m_F + b_{C2}m_{CH} + b_{C3}m_{VB} + b_{C4}Q_H + b_{C5}Q_V + b_{C6}Q_B + b_{C7}Q_L + b_{C8}T_{CIN} + Cst_C$$

In the exemplary linearized equations, $Q_X$ refers to heat generated at the nodal lumps located at an arbitrary location X, which can be based on engine speed and fuel flow. $Q_B$, for example, refers to heat generated at the nodal lump located in the engine block.

In step 128, it is determined whether the linearized model is accurate. Results from the linearized model at each linearization point are compared to those computed with the detailed model from the first portion 102 of the methodology. An operating point or linearization point is chosen as the best linearization point when the results from the simplified model most closely match the results of the linearized model at the linearization point. When the linearized model is not accurate, a different linearization point is determined in step 130. The linearization point that produces the best agreement between the linearized model and the simplified model becomes the linearization point for the entire system. When the linearized model is deemed accurate, the methodology continues with step 132.

In step 132, initial conditions are determined. More specifically, the initial temperatures for coolant at the entrance and the exit of the engine are determined and associated with the linear model. It is appreciated that when the initial conditions are known, the linear model can be solved to produce real-time temperatures at the nodal lumps that correspond to the metal temperature estimates at each of the nodes. When the vehicle is cold, it is appreciated the initial temperatures may be equal to the ambient temperature. When starting the vehicle after a short shut-down period, for example, the initial temperatures may be different throughout the engine, such that the coolant entering the engine may be a different temperature than the coolant exiting the engine.

The linearized equations can incorporate the initial conditions from step 132 and be shown in matrix form as follows:

$$\underbrace{\frac{d}{dt}\begin{bmatrix} T_H \\ T_V \\ T_B \\ T_L \\ T_C \end{bmatrix}}_{\dot{x}} = \underline{A} * \underbrace{\begin{bmatrix} T_H \\ T_V \\ T_B \\ T_L \\ T_C \end{bmatrix}}_{x} = \underline{B} * \underbrace{\begin{bmatrix} m_f \\ m_{CH} \\ m_{CB} \\ Q_H \\ Q_V \\ Q_B \\ Q_L \\ T_{CIN} \end{bmatrix}}_{u}$$

It will be appreciated that any uncertainty in, or perturbation to the initial conditions, can lead to an error in the estimated real-time temperatures, which are determined by solving the above matrix of equations. It will be further appreciated that the error caused by the uncertainty or perturbations is integrated during the solution of the differential equations and can drive the system to an unstable state.

In step 134, the control system determines estimated metal and coolant temperatures at the nodal lumps, which correspond to temperatures at the nodes at the plurality of engine locations. It can be appreciated that temperature estimates can be adjusted by a gain. It can also be appreciated that the estimation of metal and coolant temperatures can be based on the linear model.

In step 136, a measured actual engine coolant temperature (i.e. $T_{CA}$) is determined. The engine coolant temperature is determined at a location, for example, where the coolant exits the engine block in route to the radiator. As shown in the below equation, the measured actual coolant temperature ($T_{CA}$) can be used in a feedback loop to stabilize the linear model. In step 138, it is determined whether the error between the measured actual coolant temperature ($T_{CA}$) and the estimated coolant temperature (i.e. $T_{CE}$) by the linear model is within an acceptable margin or error. When the error between the measured actual coolant temperature ($T_{CA}$) and the estimated coolant temperature ($T_{CE}$) by the linear model is not within an acceptable margin of error, a suitable gain is determined in step 140. The gain determined in step 140 can be based on the error as determined in step 138 and the methodology parameters that may otherwise necessitate a higher or lower gain. From step 140, control loops back to step 134 and multiplies the estimated coolant temperature by the gain.

The gain derived from the difference between the measured actual coolant temperature ($T_{CA}$) and the estimated coolant temperature ($T_{CE}$) provides the methodology with a feedback loop for the linearized equations and makes the linear model self-correcting. An exemplary self-correcting feedback loop in an exemplary linear model in matrix form is as follows:

$$\frac{d}{dt}\begin{bmatrix}\tilde{T}_H\\ \tilde{T}_V\\ \tilde{T}_B\\ \tilde{T}_L\\ \tilde{T}_C\end{bmatrix} = A*\begin{bmatrix}\tilde{T}_H\\ \tilde{T}_V\\ \tilde{T}_B\\ \tilde{T}_L\\ \tilde{T}_C\end{bmatrix} + B*\begin{bmatrix}m_f\\ m_{CH}\\ m_{CB}\\ Q_H\\ Q_V\\ Q_B\\ Q_L\\ T_{CIN}\end{bmatrix} - L\left(\begin{bmatrix}\tilde{T}_H\\ \tilde{T}_V\\ \tilde{T}_B\\ \tilde{T}_L\\ \tilde{T}_C\end{bmatrix} - \begin{bmatrix}0\\ 0\\ 0\\ 0\\ T_{\text{Coolant_measured}}\end{bmatrix}\right)$$

The feedback loop enables the linear model to accurately estimate metal temperatures throughout the engine for any transient operating condition. It is appreciated that the set of gains used in the feedback loop can be selected and validated against the simplified (i.e. non-linear) system of differential equations and eventually against the detailed engine model to achieve accurate predictions of system temperatures in an engine.

Figure 3:
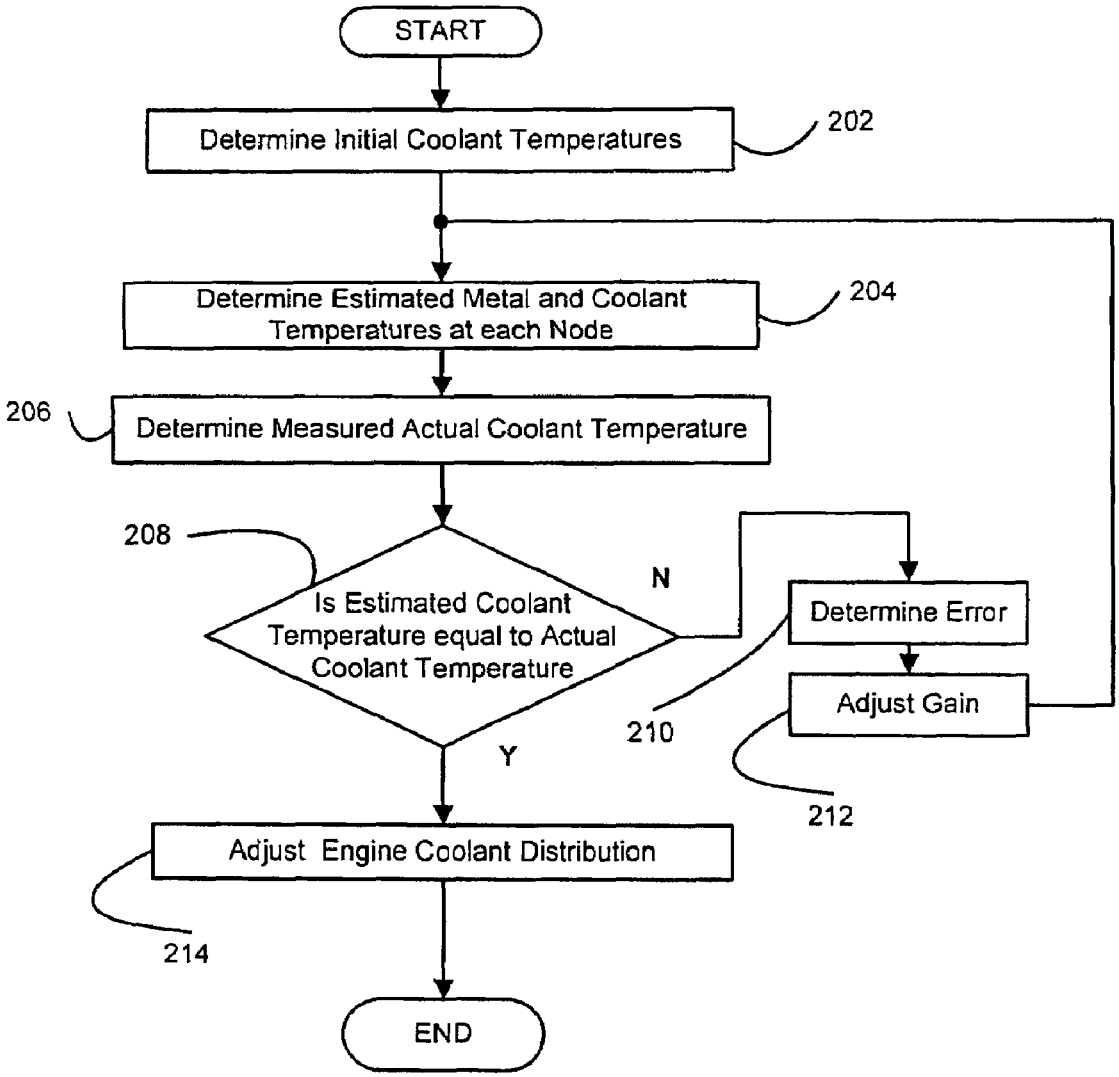
FIG. 3 is a flow chart illustrating an engine component temperature estimator control in accordance with the teachings of the present invention.

With reference to FIG. 3, an exemplary control system is shown that estimates metal temperature at an engine component derived from the methodology as illustrated in FIG. 2. In step 202, control measures initial temperatures of the coolant at the entrance and the exit of the engine. It is appreciated that in a cold engine, the coolant throughout the engine may be about equal to ambient temperatures. Determination of initial temperatures in a warm engine, however, may occur, for example, when an engine is started within a short period of time (i.e. less than twenty minutes) after being turned off.

In step 204, control determines estimated metal and coolant temperatures at each node based on the linear model as above described. The nodes of the engine are located, for example, in the engine block, the cylinder head, the valvebridge, the cylinder liner and the engine coolant. It can be appreciated that the estimated metal and coolant temperatures can be adjusted based on a gain determined in step 212. In step 206, control determines a measured coolant temperature based on a temperature-measuring device located in the engine coolant. The locations of the temperature device and the engine coolant can be, for example, at the exit of the engine block where the engine coolant is routed from the engine block to the radiator. In step 208, control determines whether the estimated coolant temperature ($T_{CE}$) is equal to the measured actual coolant temperature ($T_{CA}$). When the estimated coolant temperature ($T_{CE}$) is within an acceptable margin of error of the measured actual coolant temperature ($T_{CA}$), control ends. When the estimated coolant temperature ($T_{CE}$) is not within an acceptable margin of error of the measured actual coolant temperature ($T_{CE}$), control continues with step 210.

In step 210, the error between the estimated coolant temperature ($T_{CE}$) and the measured actual coolant temperature ($T_{CE}$) is determined. In step 212, a gain is determined based on the error and other parameters and variables from the control system that may otherwise necessitate an increase or a decrease in gain. It can be appreciated that the other parameters can include, for example, operating parameters and communication from the telematic module. From step 212, control loops back to step 204 and one or more of the metal or coolant temperature estimates can be multiplied by the gain. It is appreciated that the temperature estimate multiplied by the gain will ideally match the actual measured temperature that is determined in step 202.

In step 214, control distributes engine coolant to locations in the engine by adjusting the position of a valve and flow rate of the water pump. Distribution of coolant can be predetermined proportions to the top of the engine and the bottom of the engine. It can be appreciated that a three-way valve is illustrated (FIG. 1) but myriad valves of suitable configurations can be used that are based on specific engine configurations. As such, control can direct multiple valves and multiple water pumps through various coolant distribution configurations based on specific engines to adequately cool the engine.

Figure 4:
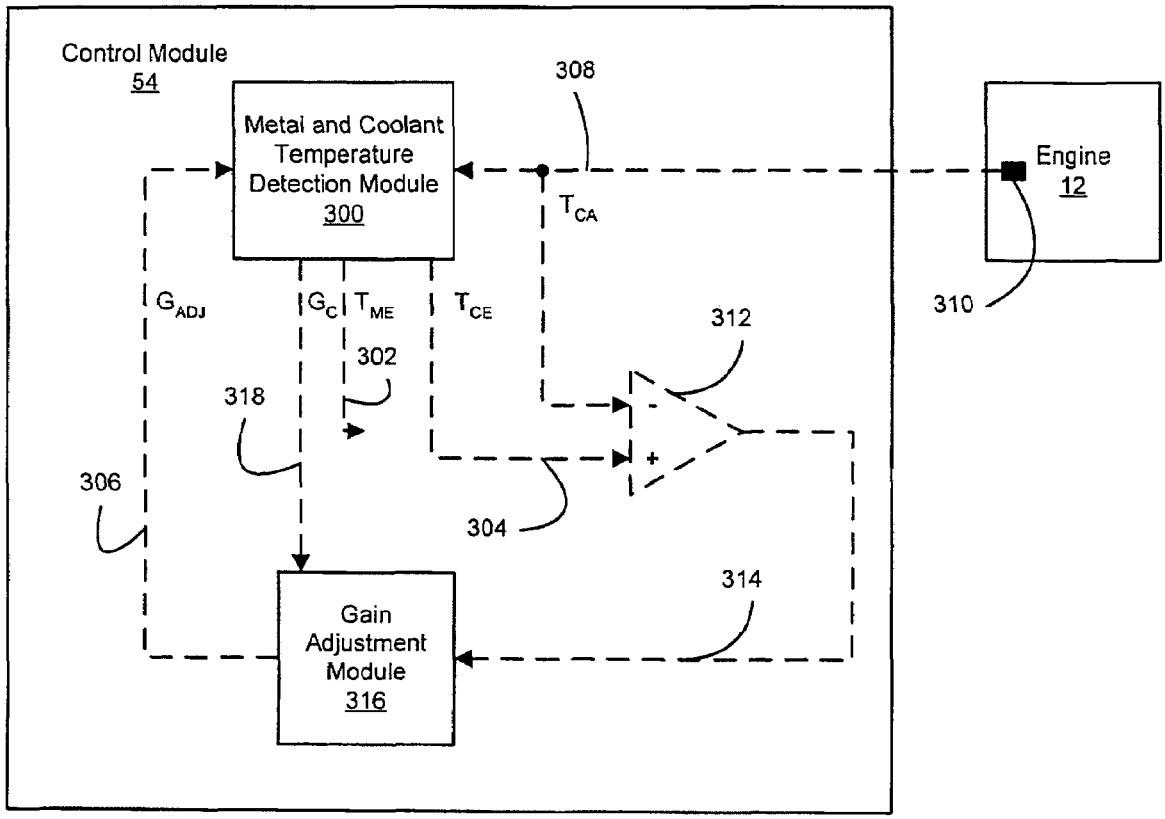
FIG. 4 is a schematic diagram illustrating the control module and the engine of FIG. 1 including a metal and coolant temperature detection module and a gain adjustment module.

With reference to FIG. 4, an exemplary temperature estimator module 300 is shown. The exemplary temperature estimator module 300 generates an estimated metal temperature signal 302 and an estimated coolant temperature signal 304. The metal temperature signal can include, for example, metal temperatures ($T_{ME}$) at the plurality of nodes that correspond to the plurality of engine locations. The coolant temperature signal can include, for example, coolant temperatures ($T_{CE}$) at the plurality of nodes that correspond to the plurality of engine locations.

The estimated metal temperature signal 302 and the estimated coolant temperature signal 304 are based on a gain adjustment signal 306 and an actual coolant temperature signal 308. The engine 12 (FIG. 1) includes a coolant temperature detection sensor 310 that generates the actual coolant temperature signal 308. It can be appreciated that the actual coolant temperature signal 308 can be, for example, a signal from a temperature-measuring device that measures actual coolant temperature ($T_{CA}$). A comparing module 312 generates a comparison signal 314 based on the actual coolant temperature signal 308 and the estimated coolant temperature signal 304. The comparing module, for example, can determine a difference between the actual coolant temperature ($T_{CA}$) and the estimated coolant temperatures ($T_{CE}$).

A gain adjustment module 316 generates a gain adjustment signal 306 based on a gain control signal 318 and the comparison signal 314. It can be appreciated that the gain adjustment module 316 can also generate the gain adjustment signal 306 based on operating parameters 56 (FIG. 1) and communication with the telematic module 58 (FIG. 1). It can further be appreciated that the gain adjustment signal can be based on specific vehicle model information. The metal and coolant temperature detection module can adjust a gain based on the gain adjustment signal 306. The estimated metal temperature signal 302 and the estimated coolant temperature signal 304 can be adjusted based on the gain to increase accuracy of the estimations.

The control system 54 can distribute coolant to the plurality of engine locations based on the estimated metal temperature signal 302 and the estimated coolant temperature signal 304. The plurality of engine locations can include, for example, the engine block, the cylinder head, the valvebridge, the cylinder liner, the engine exit coolant and portions thereof. Other engine locations can include locations that are specific to the vehicle model.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A method comprising:

estimating metal temperatures at each of a plurality of nodes in an engine;

estimating a coolant temperature;

detecting a measured coolant temperature;

determining a gain based on a difference between said estimated coolant temperature and said measured coolant temperature; and adjusting said estimated metal temperatures at each of said plurality of nodes based on said gain.

2. The method of claim 1 further comprising distributing an amount of engine coolant to a plurality of engine locations based on said estimated metal and detected coolant temperatures.

3. The method of claim 1 comprising:

determining a thermal capacitance at each of said plurality of nodes; and estimating said metal temperatures and said coolant temperatures based on said thermal capacitance.

4. The method of claim 1 comprising:

determining a heat production at each of said plurality of nodes; and estimating said metal temperatures and said coolant temperatures based on said heat production.

5. The method of claim 1 comprising:

determining a heat transfer path between each of said plurality of nodes; and estimating said metal temperatures and said coolant temperatures based on said heat transfer.

6. The method of claim 1 comprising:

determining a resistance along a heat transfer path between each of said plurality of nodes; and estimating said metal temperatures and said coolant temperatures based on said resistance.

7. The method of claim 1 further comprising:

measuring initial temperatures of the engine; and adjusting said estimated metal temperatures based on said initial temperatures.

8. The method of claim 7 wherein said initial temperatures include an engine exit coolant temperature.

9. The method of claim 8 wherein said initial temperatures include an engine entrance coolant temperature.

10. A method of designing an engine component temperature estimator, comprising:

defining a plurality of nodes at a plurality of engine locations;

determining thermal information at each of said nodes;

creating a detailed thermal model of the engine based on said plurality of nodes and said thermal information;

combining said plurality of nodes into a plurality of nodal lumps, wherein each nodal lump includes said nodes from each of said engine locations;

creating a simplified thermal model of the engine based on said detailed thermal model and said plurality of nodal lumps;

estimating metal and coolant temperatures including an estimated coolant temperature based on said simplified thermal model;

comparing said estimated coolant temperature to a measured coolant temperature; and adjusting said estimated metal and coolant temperatures based on said comparison.

11. The method of claim 10 wherein said plurality of engine locations includes at least one of an engine block, a cylinder head, a valvebridge, a cylinder liner, an exit engine coolant and portions thereof.

12. The method of claim 10 wherein said thermal information includes at least one of a thermal capacitance at each of said nodes, a heat production at each of said nodes and a heat transfer between each of said nodes.

13. The method of claim 10 further comprising linearizing said simplified model about a linearization point.

14. The method of claim 10 further comprising determining a gain based on said comparison between said estimated coolant temperature and said measured coolant temperature.

15. A control system for a cooling system of a vehicle comprising:

a temperature estimator module that estimates metal and coolant temperatures at a plurality of engine locations based on a measured actual coolant temperature and a gain;

a comparing module that generates a comparison signal based on said actual coolant temperature and an estimated coolant temperature;

a gain adjustment module that adjusts said gain based on said comparison signal.

16. The control system of claim 15 further comprising a cooling system that distributes an engine coolant to said plurality of engine locations based said estimates of said metal and coolant temperatures.

17. The control system of claim 15 further comprising a control module that detects said measured coolant temperature.

18. The control system of claim 15 wherein said plurality of engine locations include an engine block, a cylinder head, a valvebridge, a cylinder liner, an engine exit coolant and portions thereof.

19. The control system of claim 15 wherein said gain adjustment module adjusts said gain based on operating parameters.

20. The control system of claim 15 wherein said gain adjustment module adjusts said gain based on a signal from a telematic module.

* * * * *